US005114020A

United States Patent [19]

Martin

[11] Patent Number: 5,114,020

[45] Date of Patent: May 19, 1992

[54] CONTAINER FOR COLLECTING AND STORING NEWSPAPERS, MAGAZINES AND OTHER ARTICLES

[75] Inventor: Thomas Martin, Augsburg, Fed. Rep. of Germany

[73] Assignee: Logo! Martin & Partner GmbH, Augsburg, Fed. Rep. of Germany

[21] Appl. No.: 568,892

[22] Filed: Aug. 17, 1990

[51] Int. Cl.[5] ..... A47F 7/00; B65B 13/02

[52] U.S. Cl. ..... 211/50; 100/34

[58] Field of Search ..... 211/50, 49.1; 100/34; 229/104, 120.32

[56] References Cited

U.S. PATENT DOCUMENTS

| | | | |
|---|---|---|---|
| 1,597,286 | 8/1926 | Pinkerton | 229/104 X |
| 2,321,802 | 6/1943 | Deubener | 100/34 |
| 2,364,518 | 12/1944 | Clouser | 100/34 |
| 2,927,697 | 3/1960 | Hoover | 100/34 |
| 3,038,403 | 6/1962 | Ovelind | 100/34 |
| 4,154,159 | 5/1979 | Ortega | 211/50 X |
| 4,934,589 | 6/1990 | Stephenson et al. | 229/120.32 X |

*Primary Examiner*—Robert W. Gibson, Jr.
*Attorney, Agent, or Firm*—Dickinson, Wright, Moon, Van Dusen & Freeman

[57] ABSTRACT

A container for collecting and storing newspapers and periodicals comprises a lower base, a cross-shaped support that rests on the lower base, and an intermediate base that rests on the cross-shaped support. Between the lower base, the cross-shaped support and the intermediate base, two receiving compartments for receiving balls of twine are defined. The container as a whole is made as a folding cardboard box and is distinguished by great stability as well as simple handling.

21 Claims, 3 Drawing Sheets

CONTAINER FOR COLLECTING AND STORING NEWSPAPERS, MAGAZINES AND OTHER ARTICLES

FIELD OF THE INVENTION

This invention relates to a container having four side walls and a base, for collecting and keeping newspapers, periodicals and the like. The base is separated from the underside of the container itself, and between this underside and the base, there is provided at least one receiving compartment having an opening leading to the outside of the container.

BACKGROUND OF THE INVENTION

A container for this purpose is known from DE-GM (German Utility Model) 84 12 523. In that container, newspapers, periodicals, and the like are deposited in the container and are collected there until the container is full. Below the bottom of the container there are two receiving compartments, each of which contain a supply of string. The string is appropriately placed over the top sides of the container and, when the container is filled, all that has to be done is to knot the string, after which the newspapers and periodicals can be removed from the container in the form of tied-up stacks.

In this known state of the art, the two receiving compartments for the balls of string are formed of special slide-in parts that are fixed to the container. These special slide-in parts, which consist of wood or metal, make the container generally uneconomical to produce.

In contrast, the purpose of the invention at hand is to improve the known container to the effect that, coupled with simple storage and transportation conditions for the container, both the structure and ease of handling will be improved and the stability of the container will be increased.

SUMMARY OF THE INVENTION

To solve this problem, the invention provides a container made essentially of a folding cardboard box. The container, on its underside, has a second base spaced from the base provided. The second base is an intermediate base that can be removed form its required position. The base of the container carries a supporting structure which, in turn, carries the intermediate base spaced from the base of the container and which, at the same time, defines at least one receiving compartment between the base and the intermediate base.

A container according to the invention, in contrast to the known prior art, includes a double base, consisting of a lower base and an upper intermediate base, which simultaneously, in connection with the supporting structure carrying the upper intermediate base, defines a receiving compartment for balls of twine. The container according to the invention can be made, stored and transported as a folding cardboard box, at little cost, and is particularly stable and steady in terms of its shape because of the double base.

To insert a new ball of twine, it is not necessary to lift the container, as in the prior art. Instead, it is only necessary to take out the removable intermediate base and, after insertion of the new balls of twine, to replace the intermediate base in its proper position.

The supporting structure could be made as a part of the folding lower base of the container. Preferably, however, it is made of a separate part that is placed loosely upon the lower base of the container. In particular, the supporting structure is made as a cross-shaped cardboard support. The two bars of the cross-shaped support, which may be secured together, run inside the container diagonally from corner area to corner area; in other words, they are received in the container in such a manner that they cannot be moved around while, at the same time, they increase the stability of the container.

The intermediate base could likewise be a part of the folding cardboard box, especially when, according to another preferred feature of the invention, the container as a whole is made with double walls. Alternatively, the additional base may be a one-piece component of the folding cardboard box. The intermediate base can be inserted loosely into the container. Preferably, the intermediate base has at least one grasping opening or handle that facilitates lifting and removing the intermediate base.

Other advantageous features of the invention result from the claims as well as from the subsequent description in which several practical examples of the invention are described in greater detail, based on the drawings. The drawings illustrate the invention, partly in a semi-schematic or schematic fashion.

DETAILED DESCRIPTION OF THE INVENTION

Figure 1:
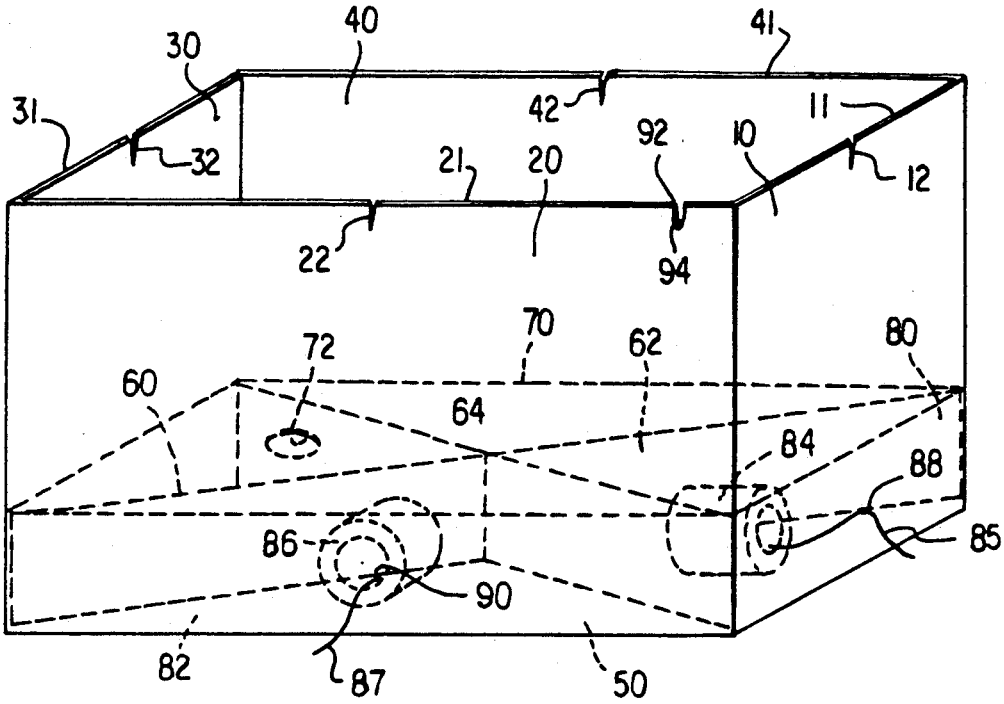
FIG. 1 is a perspective view of a container according to the invention.
Figure 2:
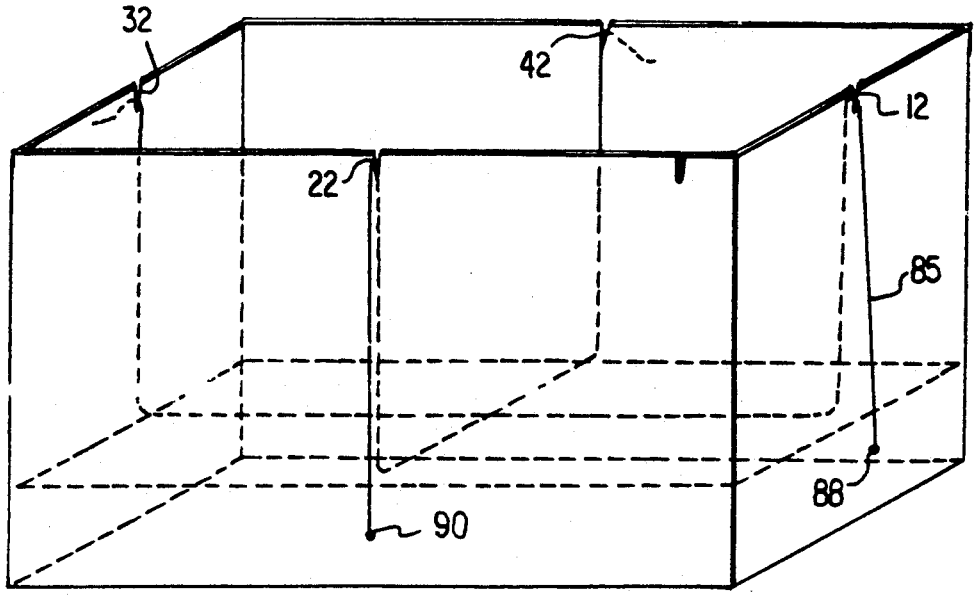
FIG. 2 is a perspective view similar to FIG. 1, illustrating the path of the twine.
Figure 3:
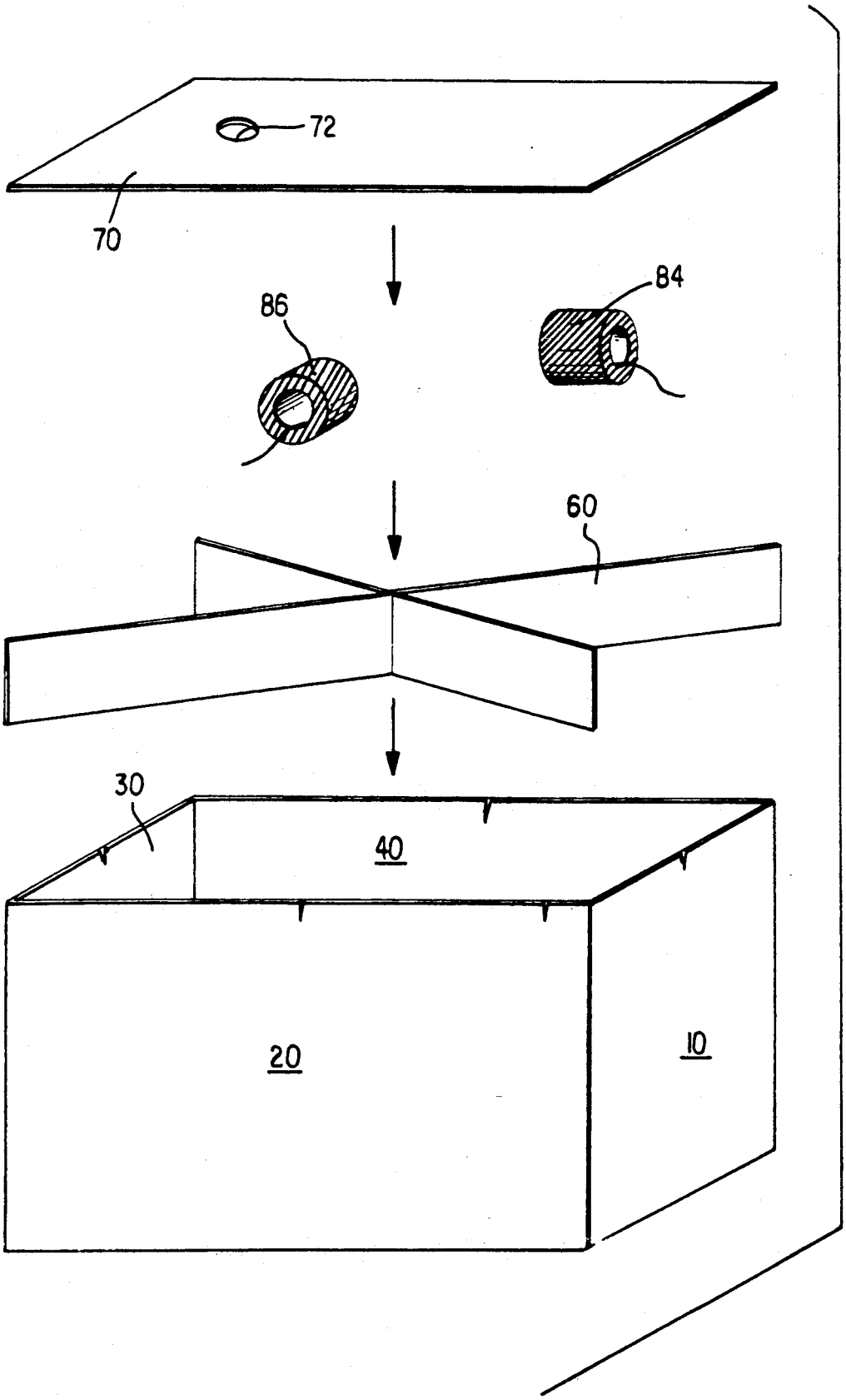
FIG. 3 is an exploded view showing assembly of the container of FIG. 1.

The box-like container according to FIGS. 1 to 4 has four side walls 10, 20, 30, and 40, a lower base 50 that closes off the underside of the container, a cross-shaped support 60 that rests on base 50, and an intermediate base 70 resting upon cross-shaped support 60. The dimension of intermediate base 70 essentially correspond to the inside dimensions of the container. Cross-shaped support 60 has two bars 62, 64, each of which runs diagonally between two side edges of the container and, in terms of its length, roughly corresponds to the diagonal. Cross-shaped support 60 subdivides the compartment between base 50 and intermediate base 70 into four receiving compartments, two of which, that is, receiving compartments 80, 82, serve as receiving compartments for a supply of twine, for example, balls of twine 84, 86. In the area of receiving compartment 80 or 82, side wall 10 or 20 includes a central aperture 88 or 90 through which twine 85 or 87 from ball of twine 84 or 86 is guided to the outside. The further guidance of the twine can be seen particularly from FIG. 2. On the upper edges 11, 21, 31, 41 of side walls 10, 20, 30, or 40, there are made, in each case, in the middle, wedge-shape cuts 12, 22, 32, or 42, that clamp the corresponding lengths of twine or ends of twine firmly. Twine 85 is guided from opening 88 upward to notch or cut 12, from there, downward to intermediate base 70, across intermediate base 70 centrally with respect to side wall 30, along side wall 30 upward to cut 32, and finally it is clamped firmly in place with its end across cut 32 with the end protruding outside. Correspondingly, string 87 is guided from opening 90 upward to cut 22, from there again downward to intermediate base 70, across intermediate base 70 to the opposite side wall 40, along side wall 40 upward to cut 42. The end of the string is clamped firmly so that it will protrude on the outside, as can be seen in FIG. 2.

When newspapers are placed in the container according to FIG. 2 and when the container is filled up, then it is only necessary to pull the strings or string ends to the corresponding length, whereby the balls of string will become unwound automatically. The strings are then cut off on one side and, finally, the strings are knotted together. The newspaper stack, thus made and tied up, can then be removed from the container. The string ends, protruding out of openings 88, 90, are then grasped and the strings are again moved into the position illustrated in FIG. 2 so that the container can be filled up again.

On upper edge 21, near side wall 10, there is another cut 92, to the base of which a knife 94 is attached. It is thus possible to sever strings 85, 87, without requiring a separate cutting tool, such as scissors or knife. If a new supply of string is to be inserted into receiving compartments 80, 82, then it is only necessary to grasp the intermediate base 70 by opening 72 therein and to lift it or to remove it from the container. After insertion of the new balls of twine and after the ends of the twine have been threaded through openings 88 or 90, intermediate base 70 is very simply again placed upon cross-shaped support 60.

The container as a whole is made of cardboard. Side walls 10, 20, 30, and 40, as well as base 50, are made in a one-piece blank for a folding cardboard box, as illustrated particularly in FIG. 4. The two bars 62, 64 of cross-shaped support 60 are separate parts, as is intermediate base 70.

Figure 4:
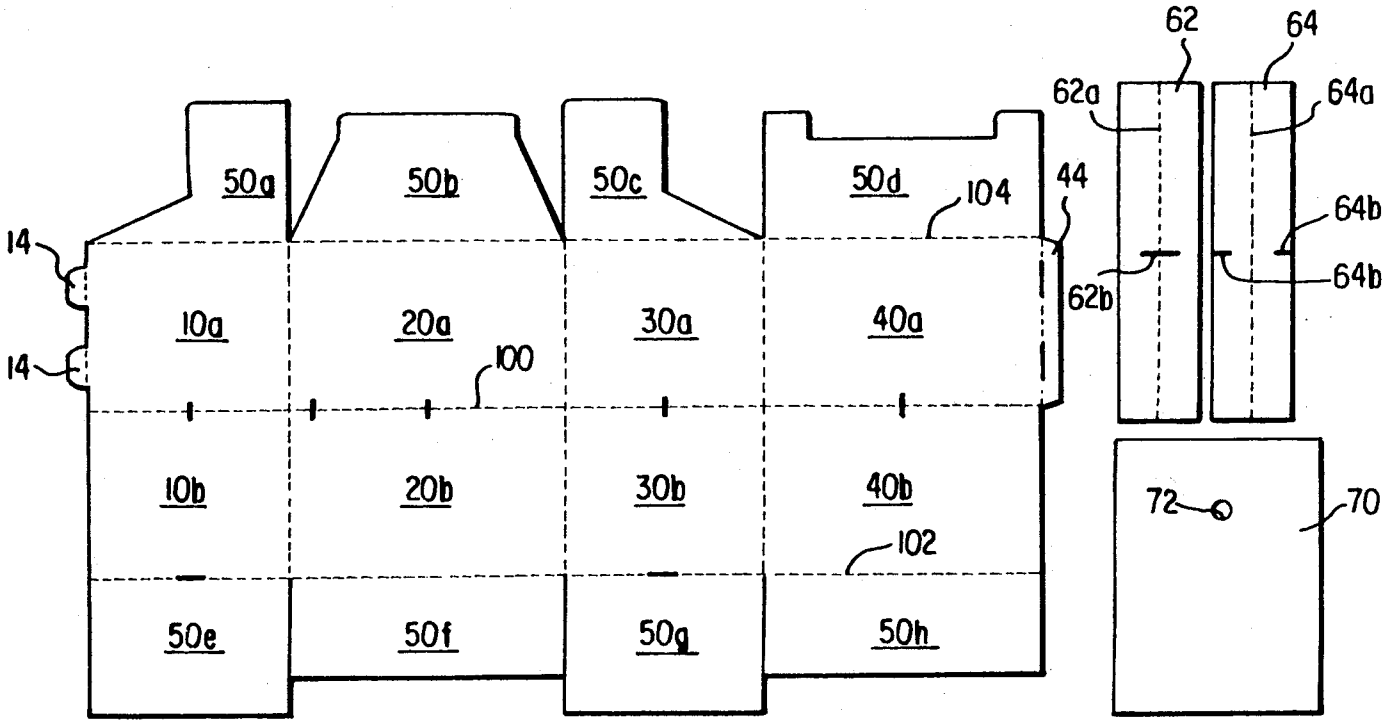
FIG. 4 is a top plan view of the individual parts of the container in the unfolded state.

The container may be made overall, in a double-wall fashion for its side walls and base. The folding cardboard blank for this purpose has a central fold 100. As illustrated in FIG. 4, side wall parts that are positioned adjacent each other are, in each case, formed above and below fold 100. When the container is assembled, fold 100 represents upper edge 11, 21, 31, 41. Side wall 10 is made up of side wall parts 10*a*, 10*b*, side wall 20 is made up of side wall parts 20*a*, 20*b*, side wall 30 is made up of wide wall parts 30*a*, 30*b*, and side wall 40 is made up of side wall parts 40*a*, 40*b*. Side wall parts 10*a*, 20*a*, 30*a*, and 40*a* form the parts which will be the outside when in the assembled state, while side wall parts 10*b*, 20*b*, 30*b*, and 40*b* form the particular parts that are located inside the container. Side wall part 10*a* is fastened to side wall part 40*a* by means of clips 14 that are formed on its vertical edge and inserted into corresponding slits between flap 44 of side wall part 40*a* and side wall part 40*a*.

Other folds run along the preformed fold lines 102, 104, that run parallel to fold 100 spaced at the height of the side walls. Base parts 50*a*, 50*b*, 50*c* and 50*d*, which adjoin side wall parts 10*a*, 20*a*, 30*a* and 40*a*, beyond fold line 104, form the underlying part of double-wall base 50. Base parts 50*e*, 50*f*, 50*g* and 50*h*, adjoining side wall parts 10*b*, 20*b*, 30*b* and 40*b*, beyond fold line 102, form the interior base of double-wall base 50. It should be noted that side wall parts 10*b*, 20*b*, 30*b*, and 40*b*, which lie inside the container, like the inside-lying parts 50*e*, 50*f*, 50*g*, and 50*h*, are spaced from each other, as can be seen in FIG. 4.

It can furthermore be seen in FIG. 4 that bars 62, 64 of cross-shaped support 60, likewise, in each case, consist of folding parts which, to increase stability, in each case are folded at a central fold line 62*a*, 64*a*. The two bars 62, 64 can be secured together centrally by securing slits 62*b*, 64*b* that run perpendicularly to fold lines 62*a*, 64*a*.

Figure 5:
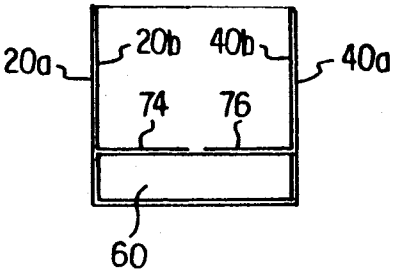
FIG. 5 is a cross-section through an alternative version of a container according to the invention.

Containers according to the invention can be offered with varying dimensions in keeping with the particular customary newspaper or periodical sizes. The version according to FIG. 5 represents a development of the practical example according to FIGS. 1–4 to the extent that, in this case, the intermediate base is not made as a separate part but rather is incorporated in the one piece folding cardboard blank and is fashioned by two (possibly overlapping) intermediate base parts 74, 76 which are connected with side wall parts 20*b*, 40*b* by corresponding fold lines. These side wall parts 20*b*, 40*b*, are made correspondingly shorter when compared to the example shown in FIG. 4.

Likewise, in an alternative development of the invention, the support structure carrying the intermediate body could be incorporated in the one piece folding cardboard blank and, for example, could be connected with several of the interior base parts 10*b*, 20*b*, 30*b*, or 40*b*.

I claim:

1. A container for collecting and storing newspapers and periodicals comprising four side walls extending upward from a substantially rectangular base, wherein an intermediate base is spaced from said rectangular base by a support structure defining a plurality of compartments between said base and said intermediate base.

2. A container for collecting and storing newspapers and periodicals comprising four side walls extending upward from a substantially rectangular base and an intermediate base spaced from said rectangular base by a support structure defining at least one compartment between said base and said intermediate base, wherein said intermediate base is removable and comprises grasping means for facilitating removal thereof.

3. A container for collecting and storing newspapers and periodicals comprising four side walls extending upward from a substantially rectangular base and an intermediate base spaced from said rectangular base by a support structure defining at least one compartment between said base and said intermediate base, wherein said intermediate base is removable and comprises grasping means for facilitating removal thereof, and wherein said support structure is positioned on said base and said intermediate base is removable and comprises grasping means for facilitating removal thereof, and wherein said support structure is positioned on said base and said intermediate base is positioned on said support structure.

4. A container according to claim 3 wherein said support structure substantially divides the space between said base and said intermediate base into at least two compartments.

5. A container according to claim 4 wherein said support structure is cross-shaped and substantially divides the space between said base and said intermediate base into four compartments.

6. A container according to claim 5 wherein said cross-shaped structure comprises bars substantially the length of diagonals of said base.

7. A container according to claim 5 wherein said cross-shaped structure comprises two bars secured together.

8. A container according to claim 1 wherein said four walls and said substantially rectangular base comprise a folded cardboard blank.

9. A container according to claim 8 further comprising passage means for threading twine in each of at least two of said walls, said passage means communicating with the space between said base and said intermediate base.

10. A container according to claim 9 further comprising passage means for passing twine substantially adjacent an upper edge of each of said walls.

11. A container according to claim 10 wherein said passage means comprises a slit in said upper edge of each of said walls.

12. A container according to claim 9 further comprising a supply of twine.

13. A container according to claim 9 wherein said cardboard blank further comprises said intermediate base.

14. A container according to claim 11 wherein said cardboard blank further comprises said intermediate base.

15. A container according to claim 8 wherein said cardboard blank is folded at an upper edge of said container to form a container comprising double walls.

16. A container according to claim 1 comprising a plurality of compartments for receiving twine between said base and said intermediate base adjacent each of two adjacent side walls of said container.

17. A container according to claim 6 wherein said supporting structure comprises a single walled cardboard structure.

18. A container according to claim 6 wherein said supporting structure comprises a double walled cardboard structure.

19. A container according to claim 11 further comprising means for cutting twine located substantially adjacent an upper edge of one of said walls.

20. A container according to claim 19 wherein said means for cutting twine comprises a knife located within a slit in an upper edge of one of said walls.

21. A container for collecting and storing newspapers and periodicals comprising four side walls extending upward from a substantially rectangular base, wherein an intermediate base is spaced from said rectangular base by a support structure defining at least one compartment between said base and said intermediate base. said four walls and said substantially rectangular base comprise a folded cardboard blank folded at an upper edge of said container to form a container comprising double walls, and wherein said base substantially comprises a double layer of cardboard.

* * * * *